US007009465B2

(12) United States Patent
Komai

(10) Patent No.: US 7,009,465 B2
(45) Date of Patent: Mar. 7, 2006

(54) ISOLATOR INCLUDING SMALL MATCHING CAPACITORS, AND COMMUNICATION APPARATUS INCLUDING THE ISOLATOR

(75) Inventor: Eiichi Komai, Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 54 days.

(21) Appl. No.: 10/800,899

(22) Filed: Mar. 15, 2004

(65) Prior Publication Data

US 2004/0183618 A1 Sep. 23, 2004

(30) Foreign Application Priority Data

Mar. 19, 2003 (JP) ..... 2003-076323

(51) Int. Cl.
*H01P 1/36* (2006.01)

(52) U.S. Cl. ..... 333/24.2; 333/1.1
(58) Field of Classification Search ..... 333/24.2, 333/1.1
See application file for complete search history.

(56) References Cited

U.S. PATENT DOCUMENTS 6,420,941 B1 7/2002 Okada et al. ..... 333/1.1

FOREIGN PATENT DOCUMENTS

| | | |
|---|---|---|
| EP | 1 087 459 | 3/2001 |
| GB | 2 350 238 | 11/2000 |

*Primary Examiner*—Stephen E. Jones
(74) *Attorney, Agent, or Firm*—Brinks Hofer Gilson & Lione

(57) ABSTRACT

In an isolator, a common electrode is disposed on a first surface of a magnetic plate. On a second surface of the magnetic plate, first, second, and third center conductors are disposed crossing each other. The center conductors have their respective first ends connected to the common electrode, and their respective second ends connected to matching capacitors. Furthermore, the second end of the third center conductor is connected to a terminating resistor. The matching capacitor connected to the third center conductor has a Q factor of 200 or smaller and a capacitance of 18 pF or larger. The matching capacitors connected to the first and second center conductors respectively have Q factors of 400 or larger.

9 Claims, 5 Drawing Sheets

ISOLATOR INCLUDING SMALL MATCHING CAPACITORS, AND COMMUNICATION APPARATUS INCLUDING THE ISOLATOR

This application claims the benefit of priority to Japanese Patent Application No. 2003-076323, herein incorporated by reference.

BACKGROUND OF THE INVENTION

1. Field of the Invention

The present invention relates to isolators and communication apparatuses. Particularly, the present invention relates to an isolator that is smaller than known isolators, and a communication apparatus including such an isolator.

2. Description of the Related Art

A lumped-constant isolator is a high-frequency component that transmits signals in direction of transmission while blocking signals in the opposite direction. A lumped-constant isolator is used, for example, in a transmission circuit of a mobile communication apparatus such as a cellular phone. Generally, an isolator includes a magnetic plate composed of ferrite or the like, a common electrode disposed on a first surface of the magnetic plate, a plurality of center conductors crossing each other on a second surface of the magnetic plate, matching capacitors respectively connected to the center conductors, and a terminating resistor connected to one of the center conductors. Since the matching capacitors require high Q factors in order to reduce insertion loss, single-plate capacitors have been used, as disclosed in U.S. Pat. No. 6,420,941.

Recently, as the functions of cellular phones are enhanced, a demand has been raised for miniaturization of isolators.

In order to achieve miniaturization of isolators while maintaining operating frequencies, the balance between the inductances of center conductors (hereinafter denoted as L) and the capacitances of matching capacitors (hereinafter referred to as C) must be considered. More specifically, miniaturization of magnetic plates is necessary for miniaturization of isolators. Thus, the lengths of center conductors become shorter, and the inductance L decreases accordingly. Particularly, when the inductance L of center conductors connected to input/output terminals becomes lower, the capacitance C of the capacitors must be increased. This, however, increases insertion loss of the isolator.

Furthermore, in order to increase the capacitance C of a single-plate capacitor, the size of the capacitor must be increased or the thickness of the capacitor must be reduced. However, the increase in the size of the capacitor is against the demand for miniaturization of the isolator, and the reduction in the thickness of the capacitor makes the capacitor more susceptible to damage. As an alternative, a multilayer capacitor that is smaller than a single-plate capacitor can be used, as disclosed in British Patent No. 2,350,238. However, generally, a multilayer capacitor has a low Q factor, and insertion loss of the isolator considerably increases.

Thus, in a proposed arrangement, a magnetic plate has a substantially rectangular shape as viewed in plan, and center conductors connected to input/output terminals are disposed along diagonal directions of the magnetic plate to maximize the lengths of the center conductors, maintaining the inductance L of the center conductors L to be high and reducing the capacitance C of the capacitors.

However, since a center conductor connected to the terminating resistor is disposed along a width direction of the magnetic plate, the inductance L of the center conductor is small. Thus, the capacitance C of a capacitor connected to the center conductor must be high. In a conventional isolator, a single-plate capacitor is used as a capacitor for a terminating side. Thus, a large capacitor must be used in order to increase the capacitance C. This has been a main factor that inhibits miniaturization of an isolator.

SUMMARY OF THE INVENTION

The present invention has been made in view of the situation described above, and an object thereof is to provide a small isolator in which a small capacitor is used for a terminating side.

The present invention, in one aspect thereof, provides an isolator in which a common electrode is disposed on a first surface of a magnetic plate, first, second, and third center conductors are disposed crossing each other on a second surface of the magnetic plate, the common electrode is connected to respective first ends of the center conductors and matching capacitors are connected to respective second ends of the center conductors, and a terminating resistor is connected to the second end of the third center conductor, wherein the matching capacitor connected to the third center conductor has a Q factor of 200 or smaller and a capacitance of 18 pF or larger, and the matching capacitors connected to the first and second center conductors have Q factors of 400 or larger.

The present invention is particularly suitable for an isolator having a size of 3.5 mm square or smaller.

According to the isolator, insertion loss can be reduced by using a capacitor with a Q factor of 200 or smaller as the matching capacitor connected to the third center conductor and a capacitor having a Q factor of 400 or larger as the matching capacitors connected to the first and second center conductors.

Furthermore, since the capacitance of the matching capacitor connected to the third center conductor is 18 pF or larger, which is relatively large, the length of the third center conductor can be made smaller, serving to reduce the size of the isolator.

According to the present invention, a capacitor having a Q factor of 200 or smaller can be used as the matching capacitor connected to the third center conductor since the third center conductor acts as a terminating electrode, so that insertion loss need not be reduced in contrast to the first and second center conductors, and insertion loss is hardly affected even when a capacitor having a relatively small Q factor is used.

In the isolator, the matching capacitor connected to the third center conductor may have a capacitance that is larger than capacitances of the matching capacitors connected to the first and second center conductors.

Accordingly, the inductance of the third center conductor becomes smaller than the inductances of the other center conductors, so that the length of the third center conductor can be made shorter. Accordingly, the size of the isolator can be reduced.

In the isolator, the matching capacitor connected to the third center conductor may be a multilayer capacitor.

As described earlier, since a capacitor having a small Q factor can be used as the matching capacitor connected to the third center conductor, it is possible to use a multilayer capacitor only for that capacitor. Accordingly, the size of the isolator can be reduced.

Alternatively, in the isolator, the matching capacitor connected to the third center conductor may be a single-plate capacitor, and a dielectric member of the single-plate capacitor has a dielectric constant of 200 or larger.

A single-plate capacitor can be suitably used as the matching capacitor connected to the third center conductor as long as the single-plate capacitor has a small Q factor and a dielectric constant of 200 or larger. That is, a small single-plate capacitor having a dielectric constant of 200 or larger can be used, serving to reduce the size of the isolator.

The isolator may be such that the magnetic plate has longer edges and is substantially rectangular as viewed in plan, central parts of the first and second center conductors are disposed in parallel to the longer edges of the magnetic plate, and the third center conductor is disposed in parallel to shorter edges of the magnetic plate.

According to the isolator; since the central parts of the first and second center conductors are disposed substantially along the direction of the longer edges of the magnetic plate, the first and second center conductors are allowed to be relatively long. Thus, the inductances of the center conductors become larger, serving to reduce insertion loss. Furthermore, by making the third center conductor disposed in parallel to the shorter edges of the magnetic plate shorter than the first and second center conductors, the width of the magnetic plate in the direction of the shorter edges can be reduced further, serving to reduce the size of the isolator.

In the isolator, the matching capacitor connected to the third center conductor may be larger in size as viewed in plan compared with the matching capacitors connected to the first and second conductors as viewed in plan.

When all the matching capacitors connected to the first to third center conductors are single-plate capacitors, by making the matching capacitor connected to the third center conductor larger than the other matching capacitors, the capacitances of the other matching capacitors can be made relatively small. This serves to reduce insertion loss.

In the isolator, the matching capacitor connected to the third center conductor may have a thickness that is smaller than thicknesses of the matching capacitors connected to the first and second center conductors.

When all the matching capacitors connected to the first to third center conductors are single-plate capacitors, by making the thickness of the matching capacitor connected to the third center conductor smaller than the thicknesses of the other matching capacitors, the capacitances of the other matching capacitors can be made relatively small. This serves to reduce insertion loss.

In the isolator, the matching capacitor connected to the third center conductor may have a dielectric constant that is larger than dielectric constants of the matching capacitors connected to the first and second center conductors.

When all the matching capacitors connected to the first to third center conductors are single-plate capacitors, by making the dielectric constant of the matching capacitor connected to the third center conductor larger than the dielectric constants of the other matching capacitors, the capacitances of the other matching capacitors can be made relatively small. This serves to reduce insertion loss.

The present invention, in another aspect thereof, provides an isolator in which a common electrode is disposed on a first surface of a magnetic plate, first, second, and third center conductors are disposed crossing each other on a second surface of the magnetic plate, the common electrode is connected to respective first ends of the center conductors and matching capacitors are connected to respective second ends of the center conductors, and a terminating resistor is connected to the second end of the third center conductor, wherein the matching capacitor connected to the third center conductor has a capacitance that is larger than capacitances of the matching capacitors connected to the first and second center conductors.

The present invention, in another aspect thereof, provides a communication apparatus including one of the isolators described above, a transmission circuit connected to the first or second center conductor of the isolator, and an antenna connected to the second or first center conductor of the isolator.

Since the communication apparatus includes one of the small isolators described above, the communication apparatus can be made smaller.

DESCRIPTION OF THE PREFERRED EMBODIMENTS

Figure 1A:
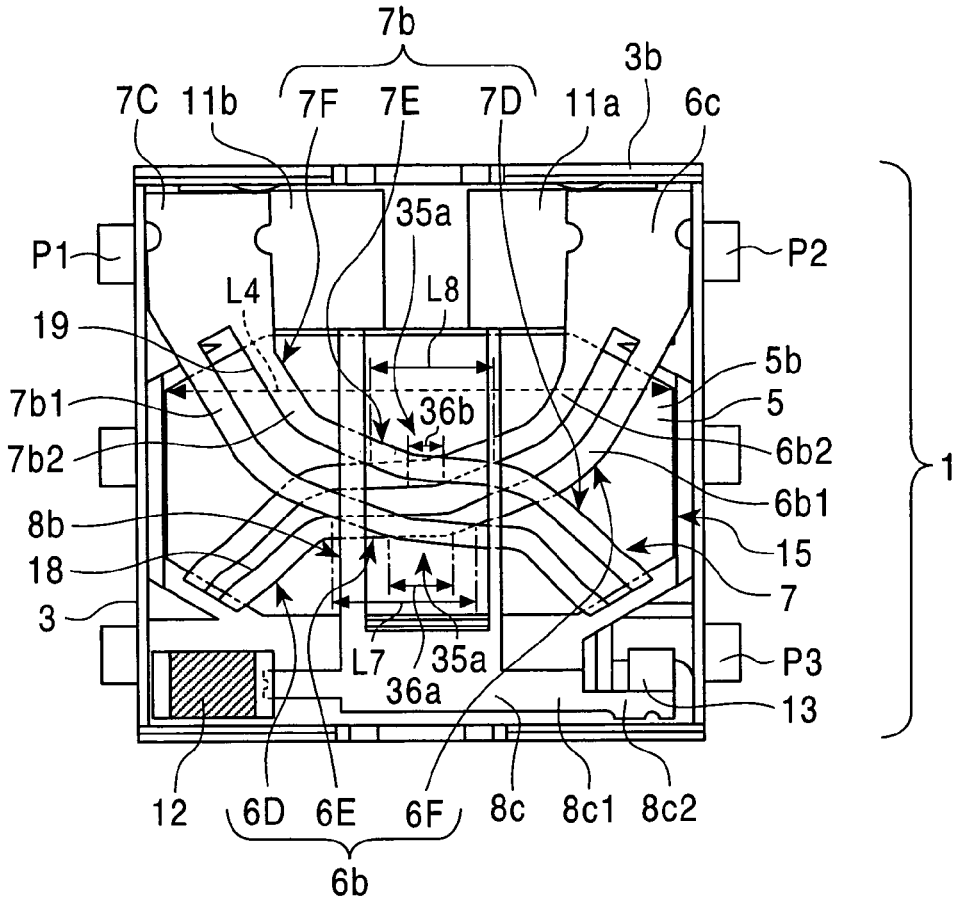
FIG. 1A is a plan view of an isolator according to an embodiment of the present invention, with a part of the isolator removed.

Now, an embodiment of the present invention will be described with reference to the drawings.

FIGS. 1A to 3 show an isolator according to an embodiment of the present invention. An isolator 1 according to this embodiment includes a closed magnetic circuit formed by an upper yoke 2 and a lower yoke 3. The closed magnetic circuit contains a magnetic assembly 15, capacitors (matching capacitors) 11*a*, 11*b*, and 12, and a terminating resistor 13 disposed in the periphery of the magnetic assembly 15.

Figure 1B:
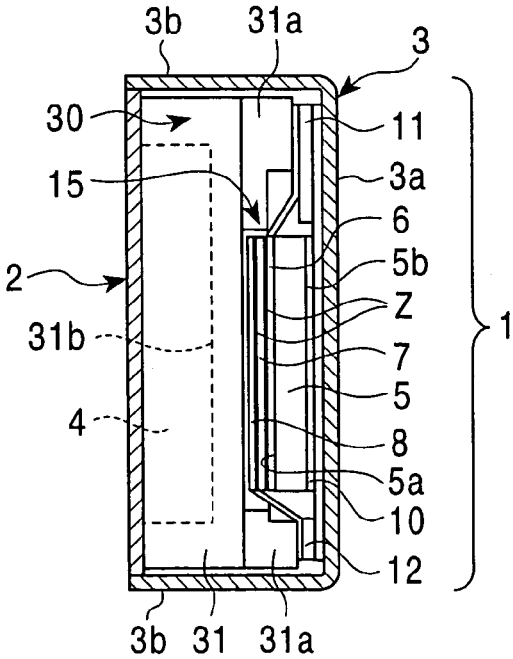
FIG. 1B is a sectional view of the isolator.

Referring to FIGS. 1A and 1B, in the magnetic assembly 15, a common electrode 10 is disposed on a first surface 5*a* of a magnetic plate 5. On a second surface 5*b* of the magnetic plate 5, first, second, and third center conductors 6*b*, 7*b*, and 8*b* are disposed crossing each other. The center conductors 6*b*, 7*b*, and 8*b*, have their respective first ends connected to the common electrode 10, and their respective second ends connected to the capacitors 11*a*, 11*b*, and 12. Furthermore, the second end of the third center conductor 8*b* is connected to the terminating resistor 13. Furthermore, insulating sheets Z are disposed between the magnetic plate 5 and the first, second, and third center conductors 6*b*, 7*b*, and 8*b*, respectively, so that the center conductors 6*b*, 7*b*, and 8*b* are insulated individually.

The magnetic assembly 15 is disposed at a central part of a bottom part of the lower yoke 3. The capacitor 12 is contained in one side of the magnetic assembly 15 on the bottom side of the lower yoke 3. The capacitors 11*a* and 11*b* are contained in the other side of the magnetic assembly 15. The terminating resistor 13 is contained on one side of the capacitor 12.

The capacitor 11*a* is connected to a leading-end conductor 6*c* formed on the side of the second end of the first center conductor 6*b*. The capacitor 11*b* is connected to a leading-end conductor 7*c* formed on the side of the second end of the second center conductor 7*b*. The capacitor 12 and the terminating resistor 13 are connected to a leading-end conductor 8*c* formed on the side of the second end of the third center conductor 8*b*.

The capacitor 11*b* is connected to a first port P1 of the isolator 1. The capacitor 11*a* is connected to a second port P2 of the isolator 1. The terminating resistor 13 is connected to a third port P3 of the isolator 1.

The magnetic assembly 15 has a thickness that occupies about half of the thickness of the gap between the upper yoke 2 and the lower yoke 3. On one side of the magnetic assembly 15, associated with the upper yoke 2, a spacer 30 shown in FIG. 1B is contained, and a magnetic member 4 is provided together with the spacer 30.

The spacer 30 includes a base 31 that is a rectangular plate as viewed in plan, and legs 31*a* formed at the respective corners of a bottom side of the base 31. On the base 31, a circular concavity 31*b* is formed on the surface opposite to the legs 31*a*. The magnetic member 4 implemented by a permanent magnet is engaged with the concavity 31*b*.

As shown in FIG. 1A, the magnetic plate 5 substantially has a shape of a rectangle having longer edges, as viewed in plan. The first and second center conductors 6*b* and 7*b* are disposed so that central parts 6E and 7E thereof are parallel to the lengthwise direction of the magnetic plate 5 (the horizontal direction as viewed in FIG. 1A). The third center conductor 8*b* is disposed in parallel with the widthwise direction of the magnetic plate 5 (the vertical direction as viewed in FIG. 1A). Thus, the third center conductor 8*b* formed on the second surface 5*b* of the magnetic plate 5 has a shorter length that the first and second center conductors 6*b* and 7*b*.

Figure 2:
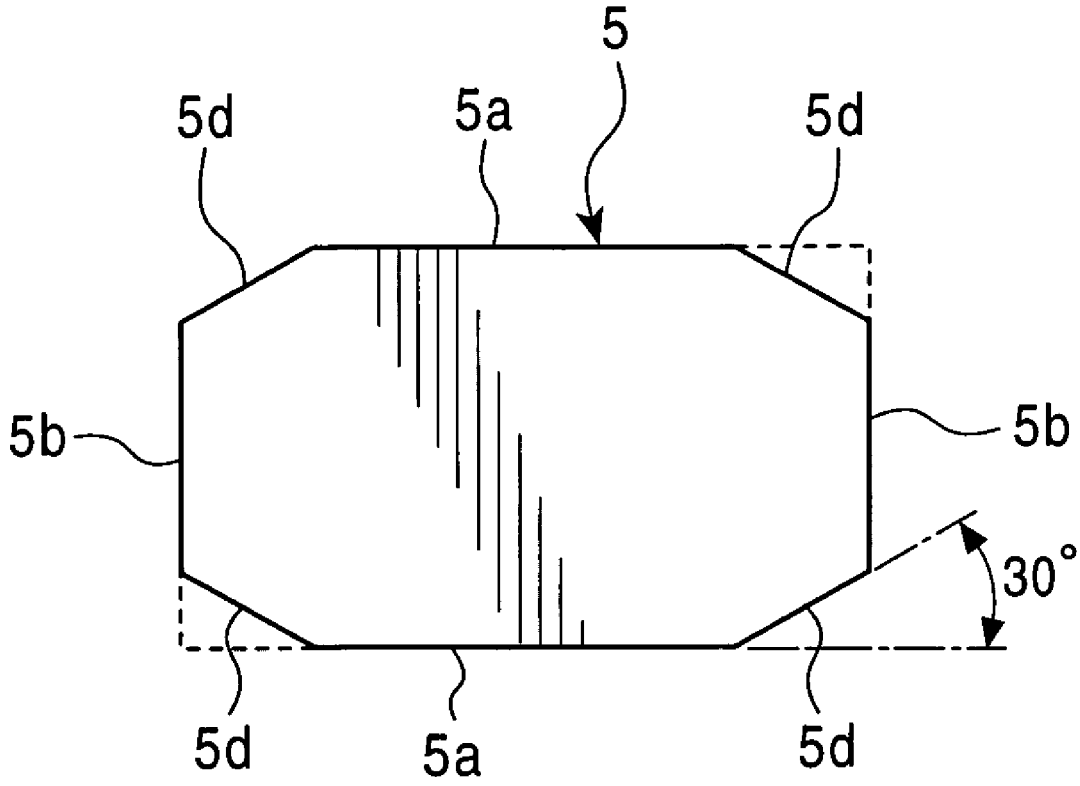
FIG. 2 is a plan view of an example of a magnetic plate included in the isolator according to the embodiment.

More specifically, as shown in FIG. 2, the magnetic plate 5 is defined by two longer edges 5*a* and 5*a*, two shorter edges 5*b* and 5*b*, and four gradient edges 5*d*. The shorter edges 5*b* and 5*b* are perpendicular to the longer edges 5*a* and 5*a*. The gradient edges 5*d* reside on both ends of the longer edges 5*a* at angles of 150° with respect to the longer edges 5*a* (at angles of 30° with respect to extended lines of the longer edges 5*a*), and are connected individually to the shorter edges 5*b*. Thus, gradient surfaces 5*d* are formed at the four corners, as viewed in plan, of the magnetic plate 5.

Furthermore, as shown in FIGS. 1A and 1B, the first and second center conductors 6*b* and 7*b* are bent along the lower gradient surfaces 5*d* and 5*d* of the magnetic plate 5 as viewed in FIG. 2, and are thereby wound from the first surface 5*a* to the second surface 5*b* of the magnetic plate 5. The third center conductor 8*b* is bent along the upper longer edge of the magnetic plate 5 as viewed in FIG. 2, and is thereby wound to the second surface 5*b* of the magnetic plate 5.

As described above, the first and second center conductors 6*b* and 7*b* are disposed such that the central parts 6E and 7E thereof are substantially parallel to the lengthwise direction of the magnetic plate 5. Thus, the first and second center conductors 6*b* and 7*b* are allowed to have relatively long lengths. This serves to increase the inductances of the center conductors 6*b* and 7*b* and to thereby reduce insertion loss. Furthermore, by making the third center conductor 8*b* shorter than the first and second center conductors 6*b* and 7*b*, the width of the magnetic plate 5 in the direction of the shorter edges thereof can be reduced. Accordingly, the size of the isolator 1 -can be reduced.

The capacitors 11*a* and 11*b* are so-called single-plate capacitors, having Q factors of 400 or larger. Since the capacitors 11*a* and 11*b* having such high Q factors are connected to the first and second center conductors 6*b* and 7*b*, insertion loss is reduced. A Q factor smaller than 400 is not preferable since insertion loss increases.

Furthermore, since the first and second center conductors 6*b* and 7*b* are disposed such that the central parts 6E and 7E thereof are substantially parallel to the lengthwise direction of the magnetic plate 5, the first and second conductors 6*b* and 7*b* are allowed to have relatively long lengths, so that the inductances of the center conductors 6*b* and 7*b* become larger. Thus, the capacitances of the capacitors 11*a* and 11*b* can be made relatively small, serving to reduce the size of the isolator 1.

The capacitor 12 is a so-called multilayer capacitor, having a Q factor of 20 or smaller and a capacitance of 18 pF or lager. The use of the multilayer capacitor serves to reduce the size of the isolator 1.

The third center conductor 8*b* connected to the capacitor 12 functions as a terminating electrode. Even if a capacitor with a Q factor of 200 or smaller is-used as the capacitor 12, insertion loss is not increased. Thus, a multilayer capacitor having a relatively small Q factor can be used. In this embodiment, a capacitor of the 1005 type (1.0 mm×0.5 mm×0.3 mm) can be used as the multilayer capacitor.

The third center conductor 8 is shorter and has a smaller inductance L compared with the first and second center conductors 6*b* and 7*b*. Thus, in order to achieve impedance matching with the first and second center conductors 6*b* and 7*b*, the capacitance of the capacitor 12 must be high to a certain extent. In this embodiment, a capacitor having a capacitance of 18 pF or larger is used as the capacitor 12 to assure impedance matching.

In this embodiment, for the purpose of impedance matching, considering that the third center conductor 8*b* is made shorter than the first and second center conductors 6*b* and 7*b*, the capacitance of the capacitor 12 connected to the third center conductor 8*b* must be larger than the capacitances of the capacitors 11*a* and 11*b* connected to the first and second center conductors 6*b* and 7*b*. The arrangement described above serves to reduce the size of the isolator 1.

In the isolator 1 according to this embodiment, a single-plate capacitor having a small Q factor as described above and having a dielectric constant of 200 or larger can be suitably used as the capacitor 12 connected to the third center conductor 8*b*. That is, if the dielectric constant is 200 or larger, a small single-plate capacitor can be used, serving to reduce the size of the isolator 1.

When a single-plate capacitor is used as the capacitor 12, all the capacitors 11*a*, 11*b*, and 12 connected to the first to third center conductors 6*b*, 7*b*, and 8*b* are implemented by single-plate capacitors. In that case, preferably, the capacitor 12 connected to the third center conductor 8*b* as viewed in plan is larger in size than the capacitors 11*a* and 11*b* connected to the first and second center conductors 6*b* and 7*b* as viewed in plan. Since the capacitance of a single-plate capacitor is proportional to the electrode area of the capacitor, i.e., the size of the capacitor as viewed in plan, the arrangement described above allows the capacitances of the capacitors 11*a* and 11*b* to be relatively small, serving to reduce insertion loss.

When all the capacitors 11*a*, 11*b*, and 12 are implemented by single-plate capacitors in an isolator according to the present invention, the thickness of the capacitor 12 is preferably smaller than the thicknesses of the capacitors 11*a* and 11*b*. Since the capacitance of a single-plate capacitor is inversely proportional to the gap between the electrodes of the capacitor, i.e., the thickness of the capacitor, the arrangement described above allows the capacitances of the capacitors 11*a* and 11*b* to be relatively small, serving to reduce insertion loss.

In this embodiment, the dimensions of the capacitors 11*a* and 11*b* are 0.75 mm (vertical)×1.05 mm (horizontal)×0.1 mm (thickness), and the dimensions of the capacitor 12 are 0.5 mm (vertical)×2.55 mm (horizontal)×0.1 mm (thickness).

Furthermore, when all the capacitors 11*a*, 11*b*, and 12 are implemented by single-plate capacitors in an isolator according to the present invention, the dielectric constant of the capacitor 12 is preferably larger than the dielectric constants of the capacitors 11*a* and 11*b*. Since the capacitance of a single-plate capacitor is proportional to the dielectric constant of a dielectric member in the capacitor, the arrangement described above allows the capacitances of the capacitors 11*a* and 11*b* to be relatively small, serving to reduce insertion loss.

Next, the constructions of the first, second, and the third center conductors 6*b*, 7*b*, and 8*b* and the common electrode 10 will be described in detail.

Figure 3:
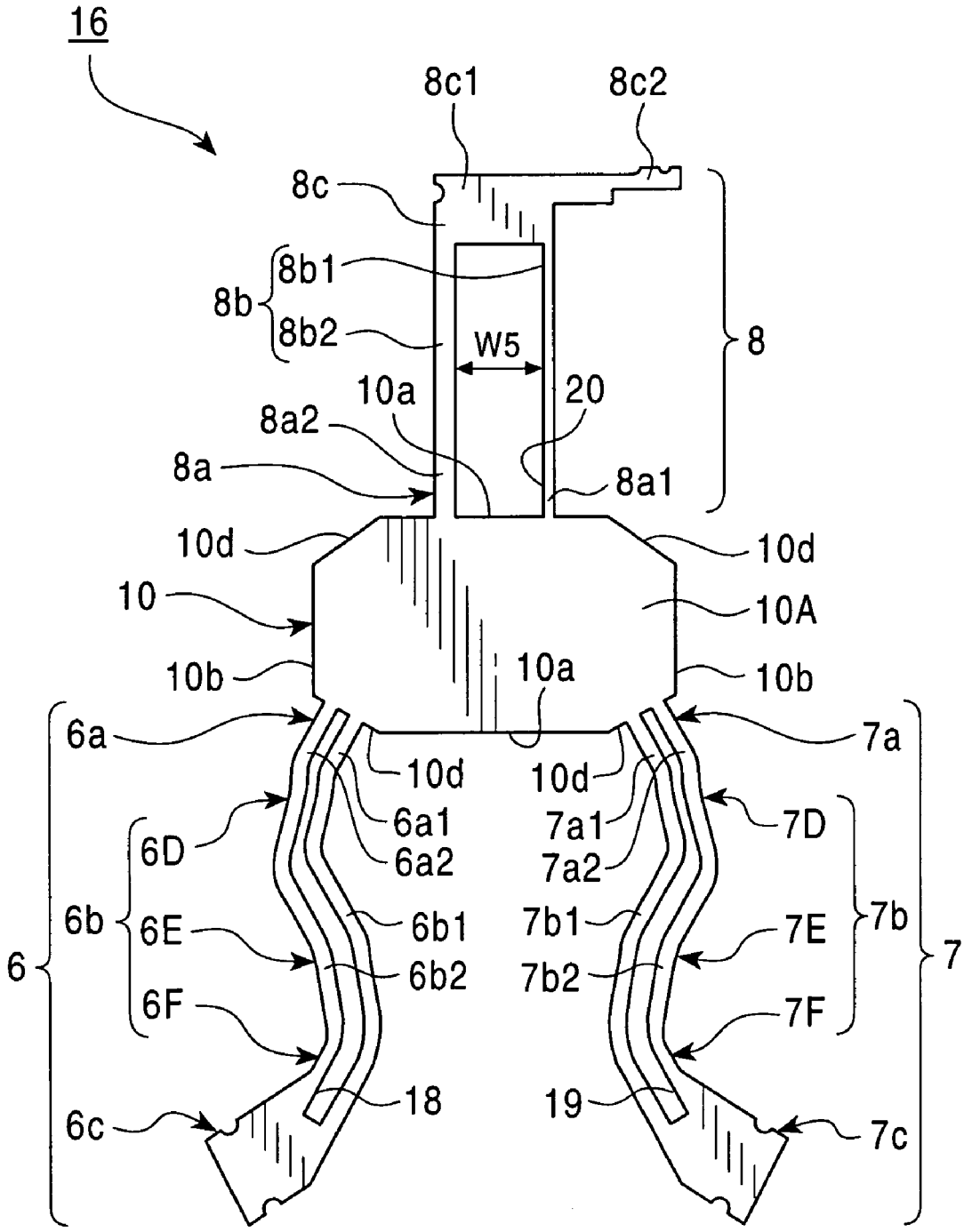
FIG. 3 is an expanded view of an electrode unit included in the isolator according to the embodiment.

As shown in the expanded view in FIG. 3, the center conductors 6*b*, 7*b*, and 8*b* and the common electrode 10 are integrated, and an electrode unit 16 is formed mainly by the center conductors 6*b*, 7*b*, and 8*b* and the common electrode 10. The common electrode 10 includes a main unit 10A composed of a metallic plate that is substantially similar to the magnetic plate 5 as viewed in plan. That is, the main unit 10A is substantially rectangular as viewed in plan, and has two longer edges 10*a* and 10*a* opposing each other, shorter edges 10*b* and 10*b*, and four gradient edges 10*d*. The shorter edges 10*b* are perpendicular to the longer edges 10*a*. The gradient edges 10*d* reside on both ends of the longer edges 10*a* at angles of 150° with respect to the longer edges 10*a* and at angles of 120° with respect to the shorter edges 10*b*.

Furthermore, as shown in FIG. 3, the first center conductor 6*b*, together with a base conductor 6*a* formed at one end thereof and the leading-end conductor 6*c* formed at the other end, forms a first transmission-line conductor 6. Similarly, the center conductor 7*b*, together with a base conductor 7*a* and the leading-end conductor 7*c*, forms a second transmission-line conductor 7. The third center-conductor 8*b*, together with a base conductor 8*a* and the leading-end conductor 8*c*, forms a third transmission-line conductor 8.

The first transmission-line conductor 6 and the second transmission-line conductor 7 are extended from the two gradient edges 10*d* associated with one of the longer edges 10*a* among the four gradient edges 10*d* of the common electrode 10. Furthermore, the third transmission-line conductor 8 is extended from a central part of the other longer edge 10*a* of the common electrode 10.

The first center conductor 6*b* is corrugated or staggered as viewed in plan. The first center conductor 6*b* has a base-conductor-side end 6*d*, a leading-end-conductor-side end 6F, and a central part 6E disposed between these ends and substantially V-shaped as viewed in plan. The central part 6E is parallel to the longer edges 5*a* of the magnetic plate 5. Similarly to the first center conductor 6*b*, the second center conductor 7*b* has a base-conductor-side end 7D, a leading-conductor-end-side end 7F, and a central part 7E disposed between these ends and substantially V-shaped as viewed in plan. The central part 7E is parallel to the longer edges 5*a* of the magnetic plate 5.

Since the first and second center conductors 6*b* and 7*b* are configured as described above, the first and second center conductors 6*b* and 7*b* have longer effective lengths and therefore larger inductances, allowing low-frequency operation and miniaturization of the isolator 1.

At a central part of the first transmission-line conductor 6 with respect to the width direction, a slit 18 extending from the periphery of the common electrode 10 to the base of the leading-end conductor 6*c* through the base conductor 6*a* and the center conductor 6*b* is formed. The slit 18 separates the center conductor 6*b* into two conductor segments 6*b*1 and 6*b*2, and the base conductor 6*a* into two conductor segments 6*a*1 and 6*a*2.

Also, a slit 19 similar to the slit 18 is formed at a central part of the second transmission-line conductor 7 with respect to the width direction. The slit 19 separates the center conductor 7*b* into two conductor segments 7*b*1 and 7*b*2, and the base conductor 7*a* into two conductor segments 7*a*1 and 7*a*2.

The widths of the slits 18 and 19 are larger at the central parts 6E and 7E and the leading-end-conductor-side ends 6F and 7F of the first and second center conductors 6*b* and 7*b* than at base-conductor-side ends 6D and 7D thereof. That is, the widths of the slits 18 and 19 at the intersection of the first and second center conductors 6*b* and 7*b* are larger than the widths at other parts. The relationship of the slit widths allows appropriate setting of impedance matching without compromising isolator characteristics.

Furthermore, the widths of the conductor segments 6*b*1 and 6*b*2 of the first center conductor 6*b* are smaller than the widths of the conductor segments 7*b*1 and 7*b*2 of the second center conductor 7*b*. This prevents impedance mismatching caused by the first center conductor 6*b* being wound more adjacent to the magnetic plate 5 than the second center conductor 7*b*. Accordingly, appropriate impedance matching is achieved.

The base conductor 8*a* of the third transmission-line conductor 8 is composed of two strip-like conductor segments 8*a*1 and 8*a*2 extending substantially perpendicularly from the centers of the longer edges of the common electrode 10. Between the two conductor segments 8*a*1 and 8*a*2, a slit 20 is formed. The conductor segment 8*a*2 has a larger width than the conductor segment 8*a*1. The leading ends of the conductor segments 8*b*1 and 8*b*2 are integrated with the L-shaped leading-end conductor 8*c*. The leading-end conductor 8*c* includes a connecting portion 8*c*1 integrated with the conductor segments 8*b*1 and 8*b*2 and extending in the same direction as the conductor segments 8*a*1 and 8*a*2, and a connecting portion 8*c*2 extending substantially perpendicularly to the connecting portion 8*c*1.

When each of the two conductor segments constituting the third center conductor 8*b* is substantially linear as viewed in plan, displacement of the third transmission-line conductor 8 is inhibited when assembling the magnetic assembly 15 by winding the third transmission-line conductor 8 on the magnetic plate 5.

Furthermore, when the third center conductor 8*b* is divided into two conductor segments as described above, the bandwidth of isolation is increased as the gap W5 between the conductor segments 8*b*1 and 8*b*2 becomes larger.

Furthermore, since one of the two conductor segments 8*b*1 and 8*b*2 is made wider than the other to increase rigidity, deformation of the third transmission-line conductor 8 is prevented when assembling the magnetic assembly 15 by winding the third transmission-line conductor 8 on the magnetic plate 5. Furthermore, since one of the conductor segments 8*b*1 and 8*b*2 is made narrower, insertion loss is maintained small.

In the electrode unit 16 configured as described above, the main unit 10A of the common electrode 10 is extended along the bottom surface (first surface) of the magnetic plate 5, and the first transmission-line conductor 6, the second transmission-line conductor 7, and the third transmission-line conductor 8 are bent (wound) toward the top surface (second surface) of the magnetic plate 5. Thus, the magnetic assembly 15 is formed together with the magnetic plate 5.

Since the first and second center conductors 6*b* and 7*b* are constructed described above, when the first and second center conductors 6*b* and 7*b* are extended along the top surface (second surface) of the magnetic plate 5, the first and second center conductors 6*b* and 7*b* cross each other on the top surface of the magnetic plate 5. FIG. 1 shows the central parts 6E and 7E overlapping each other due to the crossing.

As shown in FIG. 1, the length of the overlapping part of the first and second center conductors 6*b* and 7*b* at the intersection 35*a* thereof is the length L7 of the overlapping part of the conductor segment 6*b*1 of the central part 6E and the conductor segment 7*b*1 of the central part 7E or the length L8 of the overlapping part of the conductor segment 6*b*2 of the central part 6E and the conductor segment 7*b*2 of the central part 7E. In this case, each of the lengths L7 and L8 of the overlapping parts of the conductor segments is preferably 10% or larger of the length L4 of the center conductors overlapping the top surface (second surface) of the magnetic plate 5. More preferably, each of the lengths L7 and L8 of the overlapping parts is 20% or larger of the length L4 of the center conductors overlapping the top surface (second surface) of the magnetic plate 5.

The overlapping part between the conductor segment 6*b*1 and the conductor segment 7*b*1 includes a parallel part 36*a* and a non-parallel part. Also, the overlapping part between the conductor segment 6*b*2 and the conductor segment 7*b*2 includes a parallel part 36*b* and a non-parallel part. Preferably, the length of the parallel part 36*a* is on the order of 20% to 100% of the length L7 of the overlapping part of the conductor segments, and the length of the parallel part 36*b* is on the order of 20% to 100% of the overlapping part of the conductor segments. Thus, the capacitance provided by the overlapping part of the first and second center conductors 6*b* and 7*b* is increased. Accordingly, the capacitances of the capacitors 11*a* and 11*b* connected to the transmission-line conductors can be reduced.

If the length of the parallel part 36*a* is smaller than 20% of the length L7 of the overlapping part of the conductor segments, undesirably, insertion loss increases. Also, if the length of the parallel part 36*b* is smaller than 20% of the overlapping part of the conductor segments, undesirably, insertion loss increases.

Assuming that the crossing angle of the overlapping part between the conductor segment 6*b*1 of the central part 6E and the conductor segment 7*b*1 of the central part 7E or the crossing angle between the conductor segment 6*b*2 of the central part 6E and the conductor segment 7*b*2 of the central part 7E as the crossing angle between the first and second center conductors 6*b* and 7*b* at the intersection 35*a* thereof, the crossing angle is preferably 30 degrees or smaller, and more preferably 15 degrees or smaller. If the overlapping part between the conductor segments has the parallel part 36*a* as in this embodiment, preferably, the crossing angle between the conductor segments at the parallel part 36*a* is 0 degrees or substantially 0 degrees, and the crossing angle between the conductor segments at the non-parallel part is 30 degrees or smaller. If the crossing angle between the conductor segments at the non-parallel part is larger than 30 degrees, undesirably, insertion loss increases.

In the isolator 1 according to this embodiment, shown in FIGS. 1A to 3, the capacitor 12 connected to the third center conductor 8*b* has a Q factor of 200 or smaller, and the capacitors 11*a* and 11*b* connected to the first and second center conductors 6*b* and 7*b* have Q factors of 400 or larger. Accordingly, insertion loss is reduced.

Furthermore, since the capacitor 12 connected to the third center conductor 8*b* has a capacitance of 18 pF or larger, which is relatively large, the length of the center conductor 8*b* can be reduced. Accordingly, the size of the isolator 1 can be reduced.

Furthermore, since a capacitor having a small Q factor can be used as the capacitor 12, it is possible to use a chip capacitor only for the capacitor 12. Accordingly, the size of the isolator 1 can be reduced.

Figure 4A:
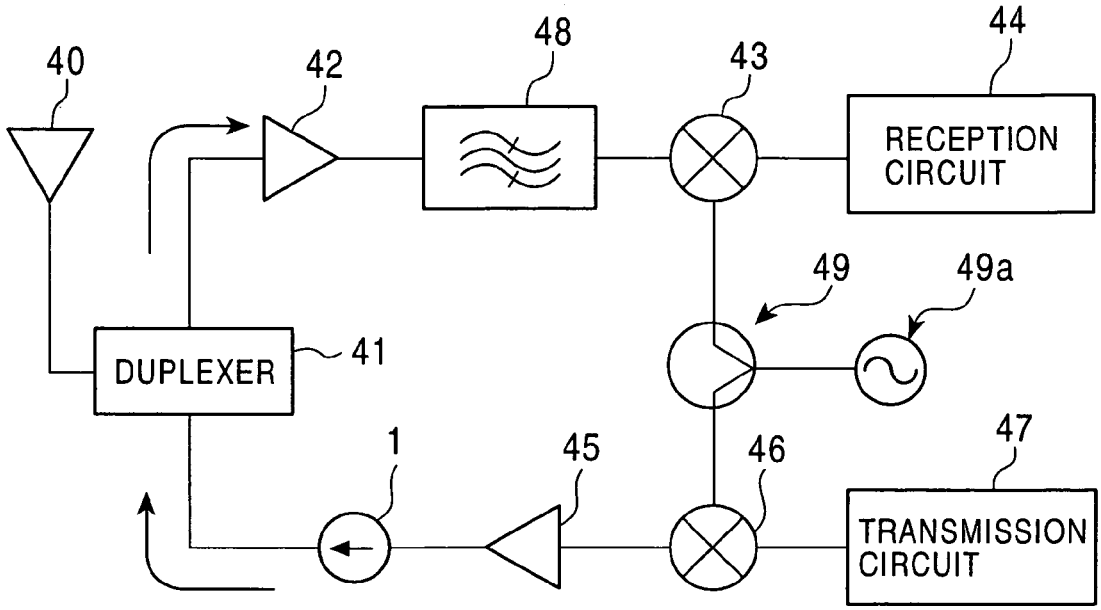
FIG. 4A is a diagram showing an example of an electric circuit including the isolator according to the embodiment.

FIG. 4A shows an example circuit configuration of a cellular phone (communication apparatus) including the isolator 1 according to the embodiment. In the circuit configuration, an antenna 40 is connected to an antenna duplexer 41. On an output side of the antenna duplexer 41, a reception circuit (IF circuit) 44 is connected via a low-noise amplifier 42, an interstage filter 48, and a selecting circuit (mixer circuit) 43. On an input side of the antenna duplexer 41, a transmission circuit (IF circuit) 47 is connected via the isolator 1 according to the embodiment, a power amplifier 45, and a selecting circuit (mixer circuit) 46. The selecting circuits 43 and 46 are connected to a local oscillator 49*a* via a distributing transformer 49.

The isolator 1 configured as described earlier is used in the circuit of the cellular phone shown in FIG. 4A. Signals directed from the isolator 1 to the antenna duplexer 41 are transmitted with only small loss, while signals directed in the opposite direction are blocked with large loss. Accordingly, unwanted signals such as noise from the amplifier 45 is inhibited from reversely entering the amplifier 45.

Figure 4B:
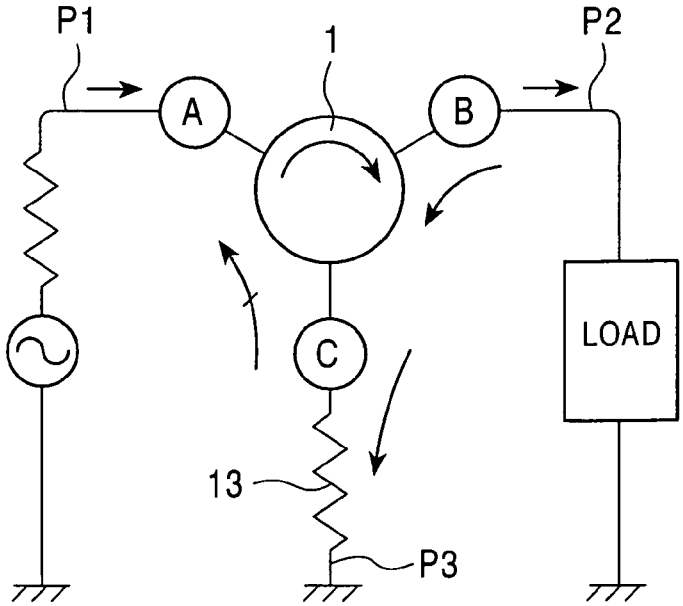
FIG. 4B is a diagram showing the principles of operation of the isolator.

FIG. 4B shows the principles of operation of the isolator 1 shown in FIGS. 1A to 3. In the isolator 1 included in the circuit shown in FIG. 4B, signals directed from the side of the first port P1, indicated by a circle labeled as A, to the side of the second port, indicated by a circle labeled as B, are transmitted. Signals directed from the side of the port P2 to the side of the third port P3, indicated by a circle labeled as C, are attenuated and absorbed by the terminating resistor 13. Signals directed from the side of the third port P3 to the side of the first port P1 are blocked.

Thus, when the isolator 1 is included in the circuit shown in FIG. 4A, the operation described earlier is achieved.

EXAMPLES

The following describes simulations of insertion loss for cases where the Q factors of the capacitors 11*a* and 11*b* are varied in the isolator 1 shown in FIGS. 1A to 3.

Example 1

In the isolator 1 shown in FIGS. 1A to 3, the magnetic plate 5 is composed of yttrium iron garnet ferrite (YIG ferrite), and has a rectangular shape with a size of 3.55 mm long, 2.0 mm wide, and 0.35 mm thick. Each of the first, second, and third center conductors 6*b*, 7*b*, and 8*b* is composed of a copper foil having a transmission-line length of 3.2 mm, an effective transmission-line width of 0.4 mm, and a thickness of 0.05 mm. The first, second, and third center conductors 6*b*, 7*b*, and 8*b* extend in three directions from the common electrode 10 having a thickness of 0.05 mm and having substantially the same size as the magnetic plate 5.

The Q factors of the capacitors 11*a* and 11*b* connected to the first and second center conductors 6*b* and 7*b* are varied to be 50, 100, 200, 300, 400, 500, 600, 700, 800, 900, 1,000, and 10,000. The Q factor of the capacitor 12 connected to the third center conductor 8*b* is chosen to be 10,000. The capacitance of the capacitor 11*a* is chosen to be 11.6 pF, the capacitance of the capacitor 11*b* is chosen to be 10.9 pF, and the capacitance of the capacitor 12 is chosen to be 23.0 pF.

In the simulation of insertion loss of the isolator 1, insertion loss is measured by calculating insertion loss for the first center 6*b* conductor and insertion loss for the second center conductor 7*b* and then averaging these values.

Example 2

The Q factors of the capacitors 11*a* and 11*b* connected to the first and second center conductors 6*b* and 7*b* are chosen to be 10,000, and the Q factor of the capacitor 12 connected to the third center conductor 8*b* is varied to be 50, 100, 200, 300, 400, 500, 600, 700, 800, 900, 1,000, and 10,000. The other parameters used in this simulation are the same as those in Example 1.

Figure 5:
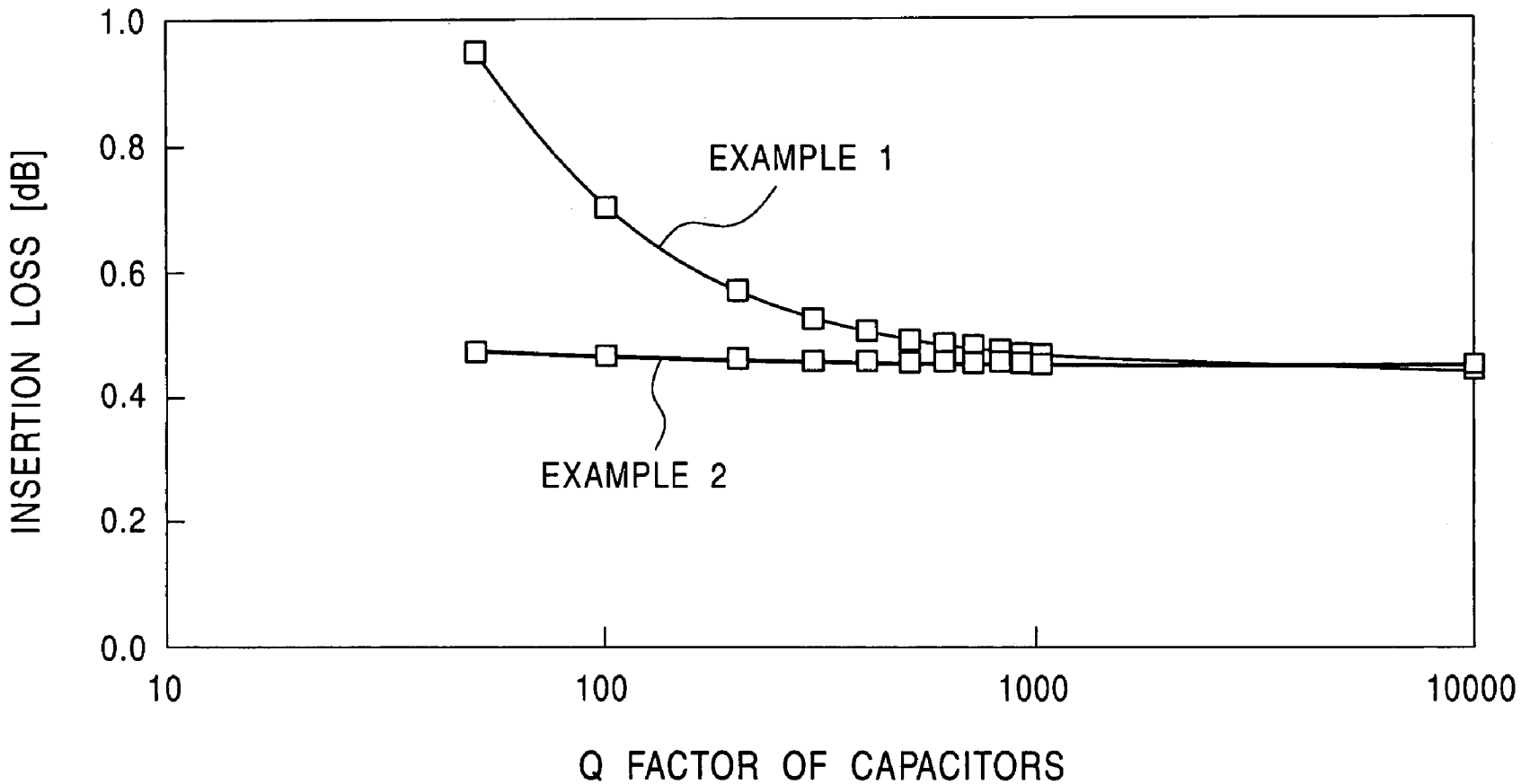
FIG. 5 is a graph showing the relationship between Q factors of capacitors and insertion loss in isolators in Examples 1 and 2.

FIG. 5 shows the relationship between insertion loss and Q factors in Examples 1 and 2. Also, Table 1 shows the relationship between insertion loss and Q factors in Examples 1 and 2.

As will be readily understood from FIG. 5, in the isolator in Example 1, when the Q factors of the capacitors 11*a* and 11*b* become smaller than 400, insertion loss gradually increases. Insertion loss becomes 0.71 dB with a Q factor of 100. This insertion loss is considerably larger compared with a typical isolator currently available.

On the other hand, in Example 2, insertion loss remains constant even when the Q factor of the capacitor 12 becomes 200 or smaller.

TABLE 1

| Q factor | Insertion loss in Example 1 (dB) | Insertion loss in Example 2 (dB) |
|---|---|---|
| 50 | 0.96 | 0.48 |
| 100 | 0.71 | 0.47 |
| 200 | 0.58 | 0.47 |
| 300 | 0.54 | 0.47 |
| 400 | 0.52 | 0.47 |
| 500 | 0.50 | 0.47 |
| 600 | 0.50 | 0.47 |
| 700 | 0.49 | 0.47 |
| 800 | 0.49 | 0.47 |
| 900 | 0.48 | 0.47 |
| 1,000 | 0.48 | 0.47 |
| 10,000 | 0.46 | 0.47 |

In the Examples, a capacitor of the 1005 type (1.00 mm (vertical)×0.5 mm (horizontal)×0.3 mm (thickness)) can be used as the multilayer capacitor. Compared with a single-plate capacitor (0.5 mm (vertical)×2.55 mm (horizontal)×0.1 mm (thickness)), the mounting area can be reduced to approximately 40%. This serves to reduce the size of the isolator.

Multilayer capacitors generally have Q factors on the order of 200 or smaller, and single-plate capacitors generally have Q factors on the order of 400 to 500. Thus, bases on the results shown above, a multilayer capacitor can be used as the capacitor 12.

What is claimed is:

1. An isolator in which a common electrode is disposed on a first surface of a magnetic plate, first, second, and third center conductors are disposed crossing each other on a second surface of the magnetic plate, the common electrode is connected to respective first ends of the center conductors and matching capacitors are connected to respective second ends of the center conductors, and a terminating resistor is connected to the second end of the third center conductor, wherein the matching capacitor connected to the third center conductor has a Q factor of 200 or smaller and a capacitance of 18 pF or larger, and the matching capacitors connected to the first and second center conductors have Q factors of 400 or larger.

2. An isolator according to claim 1, wherein the matching capacitor connected to the third center conductor has a capacitance that is larger than capacitances of the matching capacitors connected to the first and second center conductors.

3. An isolator according to claim 1, wherein the matching capacitor connected to the third center conductor is a multilayer capacitor.

4. An isolator according to claim 1, wherein the magnetic plate has longer edges and is substantially rectangular as viewed in plan, central parts of the first and second center conductors are disposed in parallel to the longer edges of the magnetic plate, and the third center conductor is disposed in parallel to shorter edges of the magnetic plate.

5. A communication apparatus comprising an isolator according to claim 1, a transmission circuit connected to the first or second center conductor of the isolator, and an antenna connected to the second or first center conductor of the isolator.

6. An isolator according to claim 1, wherein the matching capacitor connected to the third center conductor is a single-plate capacitor, and a dielectric member of the single-plate capacitor has a dielectric constant of 200 or larger.

7. An isolator according to claim 6, wherein the matching capacitor connected to the third center conductor is larger in size as viewed in plan compared with the matching capacitors connected to the first and second conductors as viewed in plan.

8. An isolator according to claim 6, wherein the matching capacitor connected to the third center conductor has a thickness that is smaller than thicknesses of the matching capacitors connected to the first and second center conductors.

9. An isolator according to claim 6, wherein the matching capacitor connected to the third center conductor has a dielectric constant that is larger than dielectric constants of the matching capacitors connected to the first and second center conductors.

* * * * *